US011096249B2

(12) United States Patent
Lee et al.

(10) Patent No.: US 11,096,249 B2
(45) Date of Patent: Aug. 17, 2021

(54) CARBON HEATING ELEMENT AND METHOD FOR MANUFACTURING A CARBON HEATING ELEMENT

(71) Applicants: LG ELECTRONICS INC., Seoul (KR); INDUSTRY FOUNDATION OF CHONNAM NATIONAL UNIVERSITY, Gwangju (KR)

(72) Inventors: Youngjun Lee, Seoul (KR); Kap Seung Yang, Gwangju (KR); Sang Wan Kim, Gyeonggi-do (KR)

(73) Assignees: LG ELECTRONICS INC., Seoul (KR); INDUSTRY FOUNDATION OF CHONNAM NATIONAL UNIVERSITY, Gwangju (KR)

( * ) Notice: Subject to any disclaimer, the term of this patent is extended or adjusted under 35 U.S.C. 154(b) by 317 days.

(21) Appl. No.: 15/986,107

(22) Filed: May 22, 2018

(65) Prior Publication Data

US 2018/0343704 A1 Nov. 29, 2018

(30) Foreign Application Priority Data

May 26, 2017 (KR) ..... 10-2017-0065488

(51) Int. Cl.
*H05B 3/14* (2006.01)
*H05B 3/44* (2006.01)
(Continued)

(52) U.S. Cl.
CPC ..... *H05B 3/145* (2013.01); *H05B 3/0076* (2013.01); *H05B 3/03* (2013.01); *H05B 3/141* (2013.01);
(Continued)

(58) Field of Classification Search
None
See application file for complete search history.

(56) References Cited

U.S. PATENT DOCUMENTS 3,189,778 A * 6/1965 Brundige ..... H01K 1/16 313/331
4,525,461 A 6/1985 Boecker
(Continued)

FOREIGN PATENT DOCUMENTS

CN 1796334 7/2006
CN 1946655 4/2007
(Continued)

OTHER PUBLICATIONS

Kim et al, "Effects of carbon and silicon on electrical, thermal, and mechanical properties of porous silicon carbide ceramics," Mar. 2020, Ceramics International, pp. 15594, 15599-15601. (Year: 2020).*

(Continued)

*Primary Examiner* — Joseph M. Pelham
(74) *Attorney, Agent, or Firm* — Ked & Associates LLP

(57) ABSTRACT

A carbon heating element and a method for manufacturing a carbon heating element are provided. The carbon heating element may efficiently dissipate heat and prevent disconnection or destruction of a heating element to prolong a lifespan thereof without generating a spark and plasma under a high voltage. The carbon heating element may include carbon (C) and silicon carbide (SiC), and the carbon heating element may have a thermal conductivity of 1.6 W/m·K or more.

6 Claims, 17 Drawing Sheets

(51) Int. Cl.
*H05B 3/03* (2006.01)
*H05B 3/00* (2006.01)

(52) U.S. Cl.
CPC ..... *H05B 3/148* (2013.01); *H05B 3/44* (2013.01); *H05B 2203/017* (2013.01); *H05B 2203/032* (2013.01)

(56) References Cited

U.S. PATENT DOCUMENTS

| | | | | |
|---|---|---|---|---|
| 5,420,399 | A * | 5/1995 | Sekhar | C04B 35/651 219/553 |
| 6,146,550 | A | 11/2000 | Le Boulch et al. | |
| 6,501,056 | B1 * | 12/2002 | Hirohata | H05B 3/145 219/553 |
| 7,769,278 | B2 * | 8/2010 | Kim | H05B 3/04 392/407 |
| 10,542,587 | B2 * | 1/2020 | Gagnon | F24H 3/002 |
| 2001/0055478 | A1 * | 12/2001 | Scherzer | H01K 1/24 392/407 |
| 2002/0142146 | A1 | 10/2002 | Gadow et al. | |
| 2002/0160902 | A1 * | 10/2002 | Lesniak | C04B 35/565 501/90 |
| 2003/0180538 | A1 | 9/2003 | Gray | |
| 2004/0043687 | A1 | 3/2004 | Kikuta | |
| 2004/0217111 | A1 * | 11/2004 | Grob | A61N 5/06 219/553 |
| 2005/0179152 | A1 * | 8/2005 | Bauer | F16D 65/125 264/29.1 |
| 2006/0272796 | A1 | 12/2006 | Asmussen et al. | |
| 2007/0032370 | A1 | 2/2007 | Weisensel et al. | |
| 2007/0034620 | A1 * | 2/2007 | Lee | H05B 3/44 219/200 |
| 2007/0110413 | A1 * | 5/2007 | Konishi | F24C 7/065 392/407 |
| 2007/0117722 | A1 * | 5/2007 | Odaka | C04B 35/565 505/100 |
| 2008/0006620 | A1 * | 1/2008 | Lee | H05B 3/0033 219/534 |
| 2008/0217323 | A1 * | 9/2008 | Baek | H05B 3/08 219/538 |
| 2012/0052196 | A1 | 3/2012 | Ma | |
| 2018/0327323 | A1 * | 11/2018 | Lee | C04B 35/565 |
| 2018/0343704 | A1 * | 11/2018 | Lee | H05B 3/145 |

FOREIGN PATENT DOCUMENTS

| | | | | |
|---|---|---|---|---|
| CN | 101562914 | | 10/2009 | |
| CN | 101765253 | | 6/2010 | |
| CN | 101880174 | | 11/2010 | |
| CN | 102558609 | | 7/2012 | |
| CN | 104755554 | | 7/2015 | |
| DE | 4413127 | | 10/1995 | |
| EP | 0 971 561 | | 1/2000 | |
| EP | 1 385 357 | | 1/2004 | |
| EP | 1741685 | | 1/2007 | |
| FR | 1300359 | | 8/1962 | |
| GB | 976468 | | 11/1964 | |
| JP | 10172738 | A * | 6/1998 | H05B 3/145 |
| JP | 11-354257 | | 12/1999 | |
| JP | 2012-051748 | | 3/2012 | |
| JP | 2016-67993 | | 5/2016 | |
| KR | 10-2007-0003836 | | 1/2007 | |
| KR | 10-2010-0117684 | | 11/2010 | |
| KR | 10-2011-0109697 | | 10/2011 | |
| KR | 10-2013-0091382 | | 8/2013 | |
| KR | 10-2015-0141382 | | 12/2015 | |
| WO | WO 93/14044 | | 7/1993 | |

OTHER PUBLICATIONS

Park et al., "Single-Crystal Growth Process of Silicone Carbide and Application Fields Thereof" Ceramist, vol. 13, Issue 6 (Dec. 2010), pp. 64-74. (English Abstract and Full Korean Text).
Chen et al., "Macro/Micro Structure Dependence of Mechanical Strength of Low Temperature Sintered Silicone Carbide Ceramnic Foams" Ceramics International, 38 (2012), pp. 5223-5229. (Full English Text).
Korean Office Action dated Jun. 5, 2018 issued in Application No. 10-2017-0065488.
European Office Action dated Sep. 5, 2019.
Korean Office Action dated May 29, 2018 issued in Application No. 10-2017-0058076.
Korean Office Action dated Nov. 14, 2018 issued in Application No. 10-2017-0058076.
European Search Report dated Nov. 30, 2018 issued in Application No. 18171796.8.
Polyak et al.; Science for Ceramic Production; High-Carbon Binders in Refractories and Corrosion-Resistant Ceramics Technology; vol. 55, No. 5-6, 1998.
U.S. Office Action dated Jul. 28, 2020 issued in U.S. Appl. No. 15/975,348.
Gerhard Brauer, et al., HeT—SiC-05, International Topical Workshop on Heteroepitaxy of 3C—SiC on Silicon and its Application to Sensor Devices, Hotel Erbgericht Krippen, Germany, Apr. 26, 2005 to May 1, 2005 (ISSN 1437-322X).
Korean Office Action dated Dec. 26, 2018 issued in Application No. 10-2017-0065488.
European Search Report dated Feb. 18, 2019 issued in Application No. 18174315.4.
Chinese Office Action dated Oct. 27, 2020 issued in Application No. 201810443605.6.
Chinese Office Action dated Aug. 12, 2020 issued in Application No. 201810520993.3.
U.S. Office Action dated Feb. 6, 2020 issued in U.S. Appl. No. 15/975,348.

* cited by examiner

| | 1400 ℃ | 1500 ℃ | 1600 ℃ | 1700 ℃ | 1800 ℃ | 1900 ℃ |
|---|---|---|---|---|---|---|
| FWHM ( deg) | 0.18 | 0.22 | 0.14 | 0.16 | 0.12 | 0.12 |

FIG. 13

[Before heat treatment]

| Element | Line Type | Apparent Concentration | k Ratio | Wt% | Wt% Sigma | Standard Label | Factory Standard | Standard Calibration Date |
|---|---|---|---|---|---|---|---|---|
| C | K series | 1.45 | 0.01449 | 59.18 | 0.20 | C Vit | Yes | |
| O | K series | 1.05 | 0.00354 | 17.06 | 0.18 | SiO2 | Yes | |
| Si | K series | 1.78 | 0.01414 | 23.77 | 0.13 | SiO2 | Yes | |
| Total: | | | | 100.00 | | | | |

[After heat treatment]

| Element | Line Type | Apparent Concentration | k Ratio | Wt% | Wt% Sigma | Standard Label | Factory Standard | Standard Calibration Date |
|---|---|---|---|---|---|---|---|---|
| C | K series | 0.43 | 0.00430 | 45.40 | 0.29 | C Vit | Yes | |
| O | K series | 0.04 | 0.00015 | 1.63 | 0.12 | SiO2 | Yes | |
| Si | K series | 3.08 | 0.02438 | 53.56 | 0.29 | SiO2 | Yes | |
| Total: | | | | 100.00 | | | | |

CARBON HEATING ELEMENT AND METHOD FOR MANUFACTURING A CARBON HEATING ELEMENT

CROSS-REFERENCE TO RELATED APPLICATIONS

This application claims priority under 35 U.S.C. § 119 to Korean Application No. 10-2017-0065488, filed on May 26, 2017, whose entire disclosure is incorporated herein by reference.

This application relates to U.S. application Ser. No. 15/975,348, filed on May 9, 2018, which is hereby incorporated by reference in its entirety. Further, one of ordinary skill in the art will recognize that features disclosed in these above-noted applications may be combined in any combination with features disclosed herein.

BACKGROUND

1. Field

A carbon heating element and a method for manufacturing a carbon heating element is disclosed herein.

2. Background

An oven may be used as a cooking appliance to heat items such as food in a home or in a commercial setting. Referring to FIG. 1, an oven 1 may be provided with a cavity 2 in which items such as food may be placed, a door 3 to selectively open the cavity 2, and a heater 6 or a plurality of heaters 6 to apply heat to the cavity 2.

The heaters 6 may be protected by a cover 8 from an exterior of the cavity 2. In order to apply electromagnetic wave heat, a magnetron 4 may be provided on the exterior of an upper surface of the cavity 2. The magnetron 4 generates electromagnetic waves, and the generated electromagnetic waves may be radiated to an inner space of the cavity 2 through a predetermined waveguide and a stirrer. In addition, a sheath heater 5 may be provided at an upper side of the inner space of the cavity, as needed.

A carbon heater that uses radiant heat may be used for the sheath heater 5 and the heater 6. A carbon fiber made of a fibrous carbon material having a carbon content of 90% or more may be used as a heating element of a carbon heater.

As the carbon fiber is made of carbon, it has a microwave absorption property of carbon itself. The carbon fiber has an inherent property that a ratio of a fiber length to a fiber diameter is very large in terms of fiber shape. The inherent properties of such carbon fiber may cause some problems when the carbon fiber is used as a heating source such as in an oven.

Referring to FIG. 2, a carbon heater 10 may include a tube 11 made of a quartz material, a carbon fiber 13, and a metal wire 15 connected opposite ends of the carbon fiber 13. An outer electrode 17 may be electrically connected via a connector 19 to the metal wire 15 to be exposed to an outside of the tube 11 through opposite ends of the tube 11. The quartz tube 11 may have a sealed interior and may be filled with inert gas or may be a vacuum so that the carbon fiber 13 arranged therein is not oxidized at a high temperature, for example, 1,000 to 1,200° C.

As shown in FIG. 3, the carbon fiber of FIG. 2 may be made of singular carbon filaments. However, the filaments each may have a diameter of several micrometers (μm), and an interval between filaments may be several micrometers (μm). Thus, when a voltage is supplied, the voltage may be applied to a very narrow distance or interval between the filaments, and as a result, a very high voltage may be applied between the filaments. For example, when an external voltage of 10 V is applied to an interval of 1 μm, a high voltage of about $10^7$ V/m may be applied between the filaments.

In this case, a local high voltage applied to the filaments may be likely to generate a dielectric breakdown and a spark. Also, when a high voltage is applied between the filaments, plasma may likely occur due to an inert gas atmosphere under a high voltage, even though a dielectric breakdown or a spark may not occur in the filaments.

A shield member may be provided between a carbon heater and a cabin to suppress the reaction of the plasma, and progress of plasma light to the cabin. However, since the shield member may not only shields the plasma light, but also may partially block radiation light emitted from the carbon heater, radiation efficiency of the oven may be greatly lowered.

KR Patent Application Publication No. 10-2011-0109697 (Oct. 6, 2011) discloses an oven of the related art, which is incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements, and wherein:

FIG. 13 shows SEM-EDS analysis results of components of the carbon heating element according to an embodiment before and after performing a third carbonization heat treatment;

DETAILED DESCRIPTION

Figure 1:
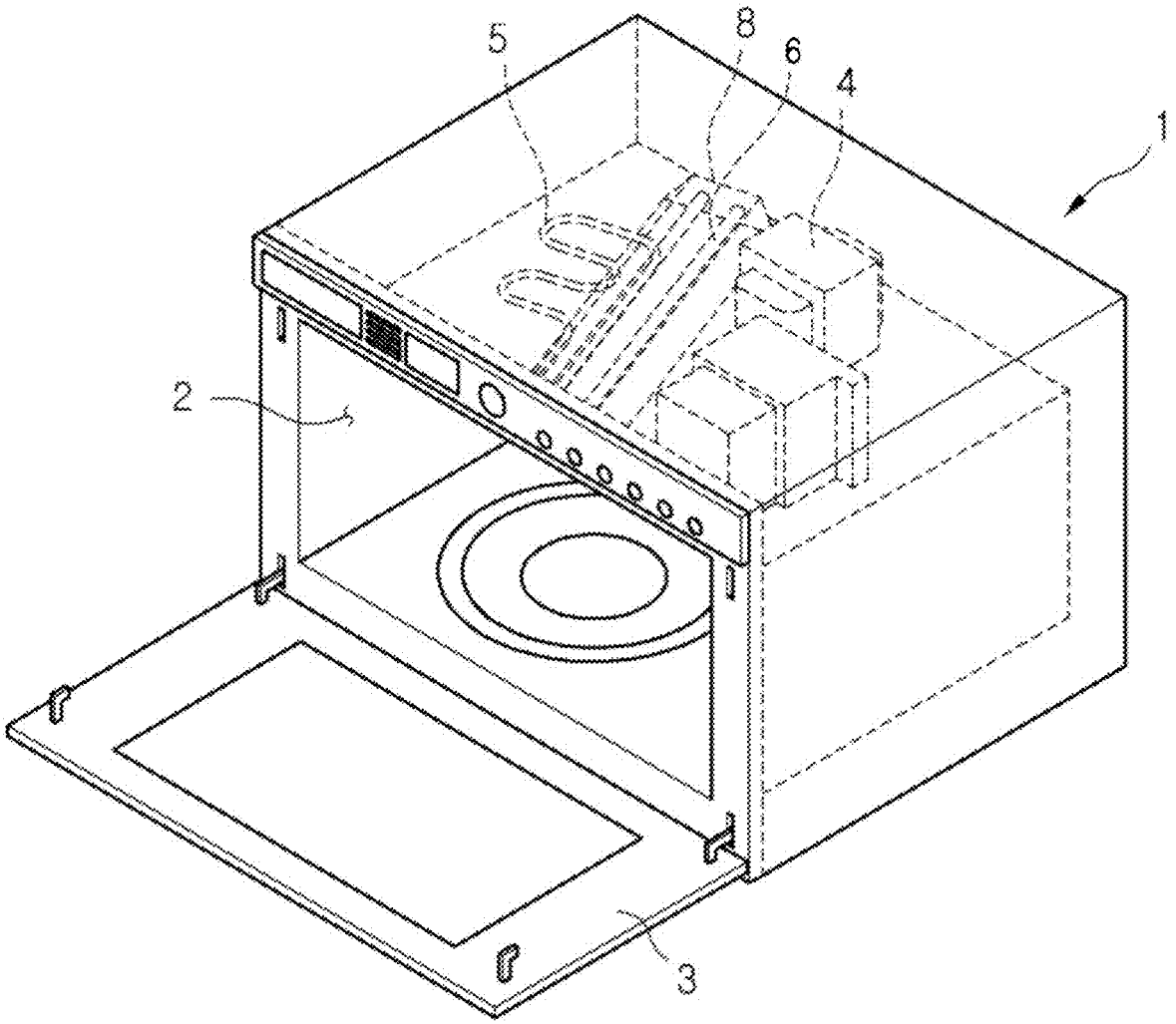
FIG. 1 RELATED ART
FIG. 1 is a perspective view of an oven.
Figure 2:
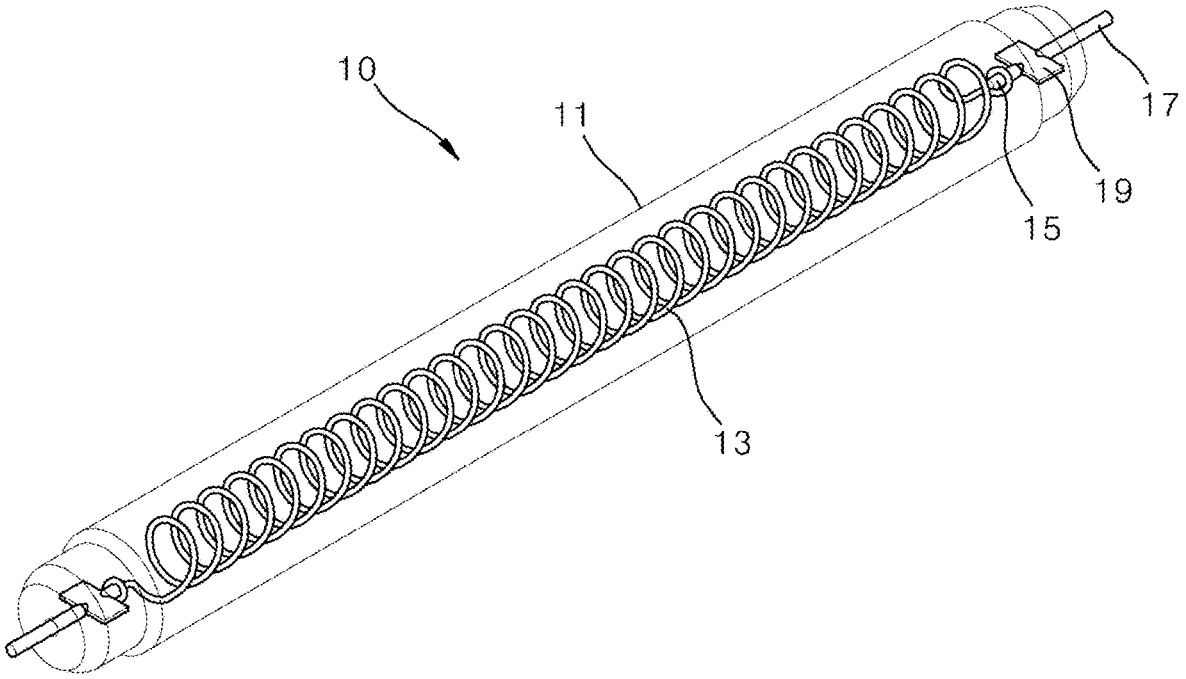
FIG. 2 RELATED ART
FIG. 2 is a view of a carbon fiber assembly in a carbon heater.
Figure 3:
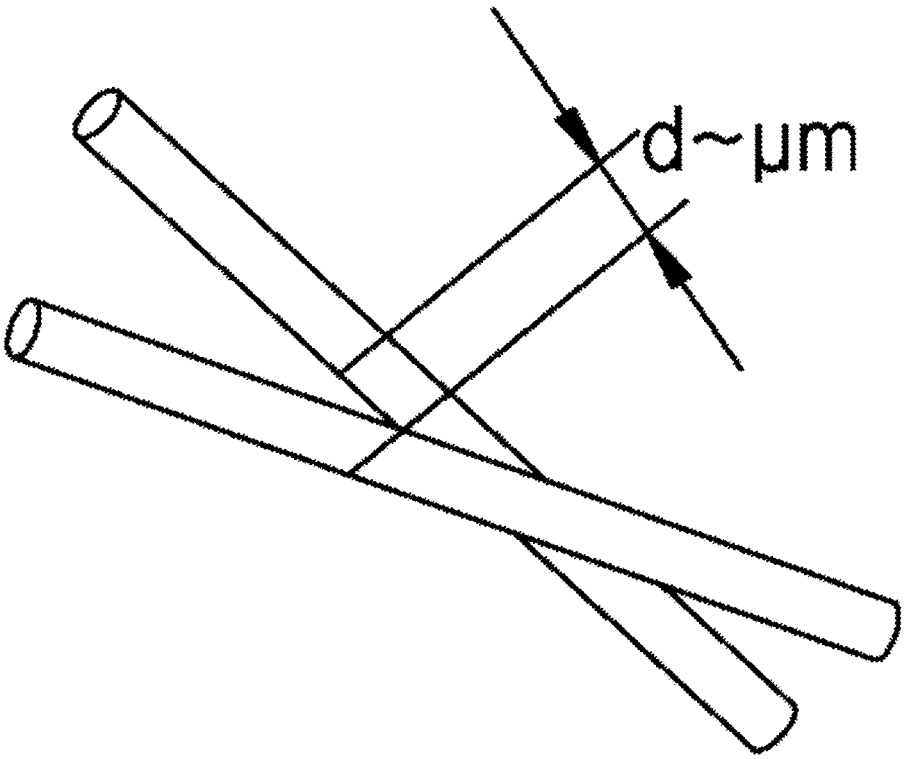
FIG. 3 is an enlarged view of carbon fiber of FIG. 2.

A carbon heating element according to an embodiment may include a heating element composition including an inorganic powder capable of serving as a main component of the heating element used as a high temperature heater and a binder that couples the powder particles to one another. The inorganic power may include various inorganic components as shown in Table 1 below.

TABLE 1

<Properties of inorganic powders>

| | Silicon Carbide (SiC) | Silicon Oxide ($SiO_2$) | Aluminium Oxide ($Al_2O_3$) | Zirconium Oxide ($ZrO_2$) | Boron Nitride (BN) | Molybdenum Silicide (MoSi) |
|---|---|---|---|---|---|---|
| Melting point (° C.) | 2,730 | 1,600° C. | 2,072° C. | 2,715° C. | 2,973° C. | 2,030° C. |
| Specific resistance (Ω · cm) | $>10^8$ | $>10^{14}$ | $>10^{14}$ | $>10^4$ | $>10^{13}$ | $2 * 10^{-5}$ |
| Thermal conductivity (W/m · K) | 41 | 1.5 | 35 | 2.7 | 20 | 25 |

The carbon heating element composition, which may be a starting material embodiments, may include at least one of the inorganic powders above. For example, SiC may be used as SiC may stably maintain specific resistance and electric conductivity, which are needed properties for the heating element. Further, if the carbon composite composition is formed without SiC, the specific resistance may be so high that a heater made of such composition may not be used as a heater.

$ZrO_2$ and MoSi each may have a disadvantage in that its specific resistance is so low that a heater made of such composition may not be used as a heating element, but they may be added to control the specific resistance of a heating element including another component as a main component. Conversely, $SiO_2$ and $Al_2O_3$ are added as a specific resistance controlling agent to control the specific resistance of a final manufactured carbon heater since they each inherently have high specific resistance.

SiC may be added in an amount of 50 to 75% based on a total weight of the composition. When SiC content is less than 50%, the specific resistance of the final manufactured carbon heater may be excessively high and the thermal conductivity thereof may be lowered, and thus disconnection may occur. When the SiC content exceeds 75%, the specific resistance of the carbon heater may be so low that the heater made of such composition may not be used as a heater.

$SiO_2$ may be added in a maximum amount of 24% based on the total weight of the composition. When $SiO_2$ content exceeds 24%, the thermal conductivity of the carbon heater may be drastically lowered, and thus a terminal disconnection may occur. Also, when the manufactured carbon heater has excessively high specific resistance due to high specific resistance inherent in $SiO_2$, an additional design change, such as, for example, reducing a length of the heater or widening a cross-sectional area thereof may be required. It may be possible to make a specific resistance controlling agent by adding $Al_2O_3$ in addition to $SiO_2$ or only adding $Al_2O_3$. Even when the specific resistance controlling agent is made of only $Al_2O_3$, its content may be limited to a maximum of 24% for the same reason as $SiO_2$.

An organic resin may be a binder. A binder is a component which may be added for mechanical coupling or adhesion between the inorganic powders at a relatively low temperature before the inorganic powders may be coupled to one another by diffusion or melting at a high temperature. The binder of the present disclosure may also perform a function of supplying carbon, which is a main component of the carbon heater of the final product.

In the binder of embodiments, a novolac resin, which is a type of phenolic resin and has excellent heat resistance, may be used. The novolac resin may be one of the phenolic resins produced by a reaction of phenol and formaldehyde, and may be generally produced when a catalyst is an acid.

However, the binder of embodiments is not limited to phenolic resins such as novolac resins. For example, a resol resin among phenolic resins may be used as the binder. In addition to phenolic resins, an organic resin, such as, for example, an acrylic resin also may be used as a binder to serve an adhesive function.

The resin used as the binder may be added in an amount of 15 to 30%, based on the total weight of the composition. When a resin content is less than 15%, not only may an extrudate obtained by performing a post extrusion process be easily broken but also a carbon content in the finally formed carbon heating element may be too low, so that the specific resistance of the carbon heating element becomes too high in comparison.

When a resin content exceeds 30%, the extrudate after the extrusion process may have poor stability in terms of a shape, and the final carbon heating element may be more likely to have a dimensional defect. The carbon content in the final carbon heating element may become higher, whereby the specific resistance of the carbon heating element may be too low in comparison. The novolac resin used may have a number average molecular weight in the range of 1,000 to 10,000, for example, a number of average molecular weight in the range of 3,000 to 7,000.

The carbon heating element composition may include a lubricant in order to reduce friction between the composition and a die during the extrusion process. In the present disclosure, the final product is a carbon heater, and thus it may include carbon as a lubricant component. For example, graphite, carbon black, and activated carbon may be used as the lubricant. Graphite, which is a widely used lubricant, has excellent lubrication properties during the extrusion process.

Graphite may perform not only a function as a lubricant but also a function as a curing agent for the novolac resin in the present disclosure. Novolac resin is not cured by itself. A curing agent called "hexamine" is separately required for thermal curing of the novolac resin.

In the embodiments, when the graphite is included in the carbon composite composition, the carbon composite composition cures on its own without the curing agent after the extrusion process is performed thereon. But, a mechanism thereof has not been identified, yet.

Even when the novolac resin is used, the curing agent, such as hexamine, may be added to the composition of embodiments. Conversely, when the resol resin is used as a binder, the curing agent is unnecessary because the resol resin may be thermally cured by itself without the curing agent.

When other resins, such as, for example, acrylic resin, are used as a binder, the binder may be cured, for example, by using the curing agent or by using thermal curing or photo curing. When photo curing is used, a photoinitiator may be additionally included. Various additives also may be included.

The graphite of embodiments may be added in an amount of 0.1 to 10% based on the total weight of the composition. When a graphite content is less than 0.1%, friction between the composition and the die may increase during the extrusion process, and after the extrusion process, the curing may be insufficient and the extrudate may have poor stability in terms of a shape, and thereby the final carbon heater may be more likely to have a dimensional defect.

Conversely when the graphite content exceeds 10%, the curing reaction may proceed too fast during the extrusion process, which may make processing such as extruding difficult, and the carbon content in the final carbon heating element may become higher, and thereby the specific resistance of the carbon heating element is low in comparison.

A carbon heater manufacturing method using the carbon heating element composition of embodiments will be described. A general method used when manufacturing another functional material using the composition may be applied to the carbon heater manufacturing method of embodiments.

Figure 4:
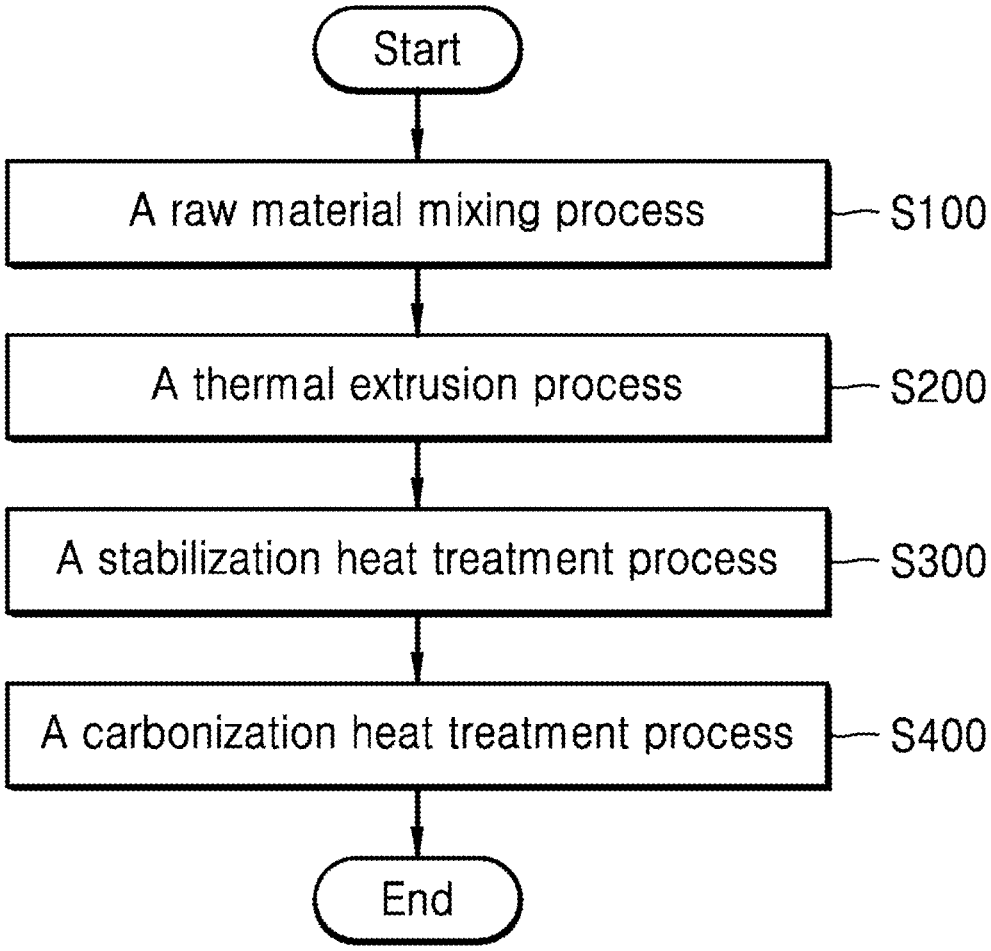
FIG. 4 is a flow chart of a method for manufacturing a carbon heating element using a carbon composite composition according to an embodiment.

As shown in FIG. 4, the manufacturing method may start with mixing an inorganic power and a phenolic resin binder (S100). In the mixing process, raw materials each having desired components and composition ranges may be mixed for a desired time using an apparatus, such as, for example, an attrition mill.

Next, the mixed raw materials may be thermally extruded using a general extruder used in the field of polymer injection (S200). An extrusion condition may be a speed of 60 rpm at 100 to 200° C., but is not limited thereto. The extrusion condition may be changed according to the components and the composition ranges of the inorganic powder and the binder. Also, an injection process using a mold instead of the extrusion process may be used.

The extruded carbon composite composition may be subjected to a stabilization heat treatment process at a high temperature (S300). The stabilizing heat treatment process (S300) may be a heat treatment process to induce a coupling structure of carbon and oxygen of the binder. The binder may be cured such that the carbon composite composition extruded as a result of the stabilization heat treatment process maintains its extruded shape to secure mechanical stability.

The stabilization heat treatment process may be performed at 270 to 320° C. for 10 minutes to 2 hours in the atmosphere. When the stabilizing heat treatment process is performed at a temperature lower than 270° C., it may be impossible to secure the curing of the binder. Conversely, although an upper limit of the stabilization heat treatment temperature is not technically limited, the temperature may not be raised to an excessively high temperature, in terms of energy.

Next, the cured composition may be subjected to a carbonization heat treatment process (S400). The carbonization heat treatment process may produce an active component of the carbon heater final product by out-gassing a volatile component among the components constituting the composition and carbonizing the remaining components.

The carbonization heat treatment process may be divided into three steps. A first carbonization heat treatment process may be performed at a relatively low temperature of 600-1,000° C. for 10 minutes to 2 hours in an inert gas atmosphere, such as, for example, with nitrogen in comparison to a subsequent second carbonization heat treatment process. The first carbonization heat treatment process may volatilize components other than carbon among the binder components, and components other than carbon which may exist in impurities included in components other than the binder components among components of the composition.

A second carbonization heat treatment process may be performed, immediately after the first carbonization heat treatment process. The second carbonization heat treatment process may be performed at a temperature of 1,200 to 1,400° C. for 10 minutes to 4 hours in the inert gas atmosphere to carbonize the remaining components of the carbon composite composition after the out-gassing step.

When the temperature of the second carbonization heat treatment process is lower than 1,200° C., the components may be incompletely carbonized, and thus the heating element of a carbon electrode may have a lower electrical conductivity. Conversely, when the temperature of the second carbonization heat treatment process is higher than 1,400° C., vaporization of the "—CC—" structure resulting from a binder material may occur too many times, and thus a yield of the heating element of the carbon electrode may be greatly lowered. In order to improve productivity, the first and second carbonization heat treatment processes may be integrated and operated in a single carbonization heat treatment process.

A separate third carbonization heat treatment process may be included to adjust or improve mechanical and/or electrical properties of the carbon heater after performing the second carbonization heat treatment process. The third carbonization heat treatment process may be performed at a temperature of 1,500 to 1,700° C. for 10 minutes to 4 hours in the inert gas atmosphere, such as, for example, with nitrogen.

When the temperature of the third carbonization heat treatment process is lower than 1,500° C., the carbon heating element may be disconnected due to low thermal conductivity. Conversely, when the temperature of the third carbonization heat treatment process is higher than 1,700 C, SiC has a higher degree of crystallization. As a result, the carbon heating element may have an excessively lowered specific resistance.

The physical properties of the final carbon heating element may be adjusted according to the components and the composition ranges of the composition for a carbon heating element. Further, the properties of the final carbon heating element may be changed through the carbon heater manufacturing method of the present disclosure, even though the same composition is used.

Figure 5:
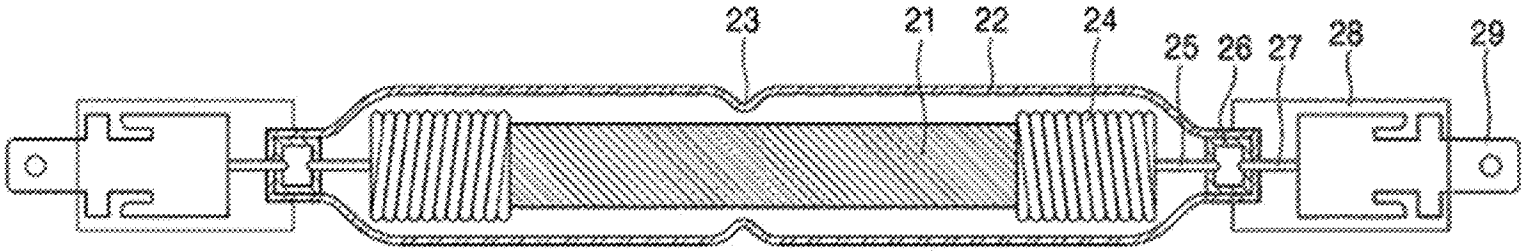
FIG. 5 is a view of a carbon heater according to an embodiment.

A carbon composite produced after the third heat treatment process may be combined with a connector and a sealing tube to manufacture a carbon heater according to an embodiment, as shown in FIG. 5. The carbon heater may include a heating element 21 made of the carbon composite and a connector 24 that supports the heating element 21 and supplies power. Also, the carbon heater further may include a tube 22 that encloses the heating element 21 and contains inert gas, a groove portion or groove 23, a metal wire 25 that supplies electricity to the heating element 21, a metal piece 26, an outer electrode 27, an outer connector 28, and an outer terminal 29.

EXAMPLE

A quaternary composition was prepared by adding 15 to 30 wt. % (hereinafter referred to as "%" or "wt. %") of a novolac resin as a binder and 0.1 to 10% of graphite as a lubricant to the inorganic powder, which was based on 50 to 75% of SiC and further included $SiO_2$ as a specific resistance controlling agent, among the inorganic power components shown in Table 1 above. According to the method shown in FIG. 4, the prepared quaternary composition was mixed uniformly through mixing raw materials, and extruded. Subsequently, the extruded composition was subjected to the stabilization heat treatment process and the first to third carbonization heat treatment processes, and followed by being processed into a final carbon heating element. The electrical properties of the final carbon heating element were evaluated.

Figure 6:
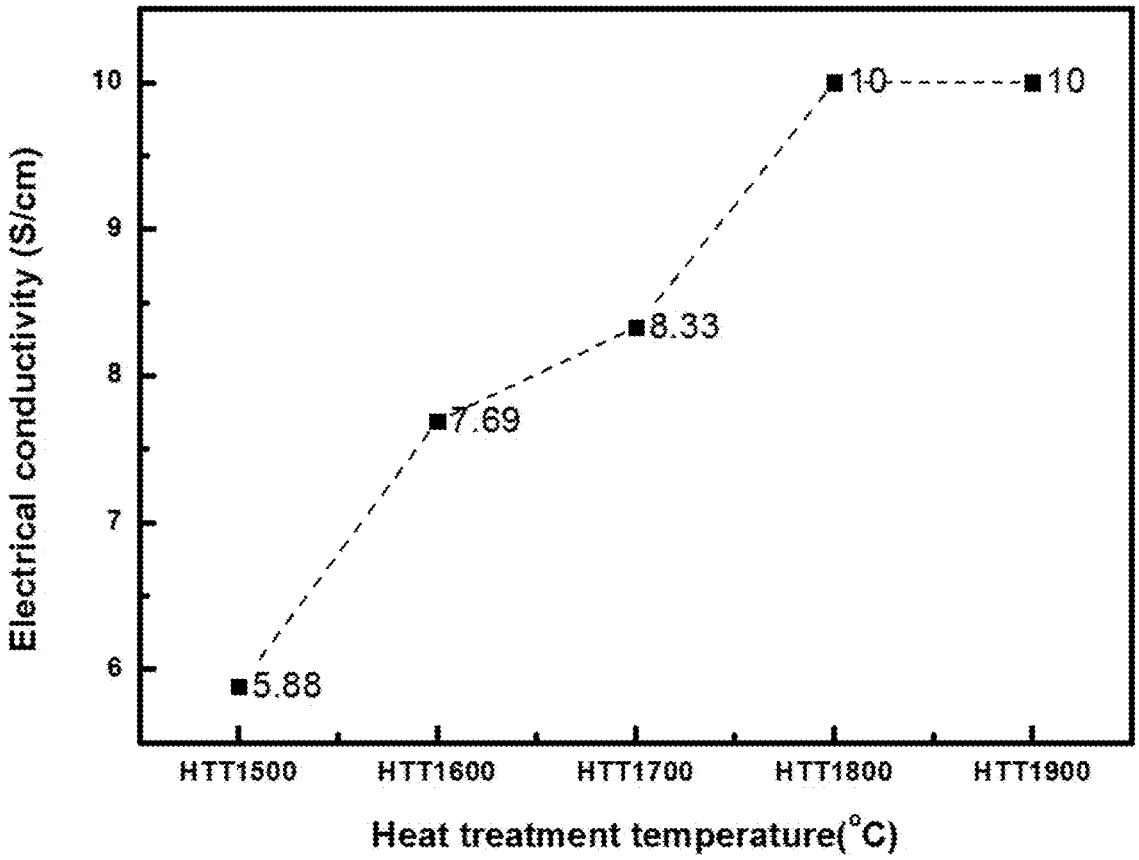
FIG. 6 shows electrical conductivity of a carbon heating element according to an embodiment versus third carbonization heat treatment temperature.
Figure 7:
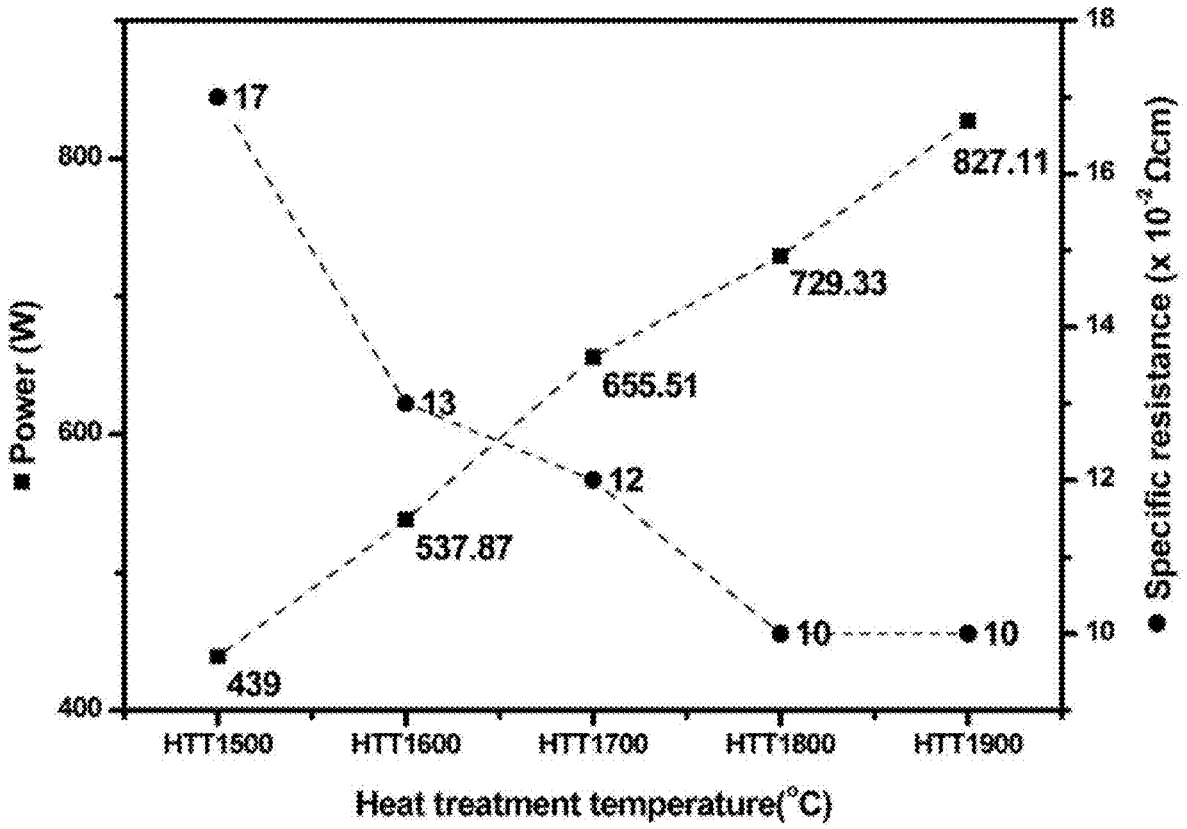
FIG. 7 shows specific resistance and power of the carbon heating element versus third carbonization heat treatment temperature.

FIG. 6 and FIG. 7 show the electrical conductivity properties (FIG. 6) and the specific resistance and power properties (FIG. 7) of the composition including 59% of SiC, 15% of $SiO_2$, 23% of the binder resin and 3% of the lubricant among the compositions of embodiments based on the third carbonization heat treatment temperature. As shown in FIG. 6, the electric conductivity of the carbon heating element increases in line with an increase in the third carbonization heat treatment temperature. In FIG. 7, specific resistance, which is the inverse of the electrical conductivity, decreases in line with an increase in the third carbonization heat treatment temperature. Property changes of the carbon heating element of embodiments based on the third carbonization heat treatment temperature are not limited to the above described electrical properties.

Figure 8:
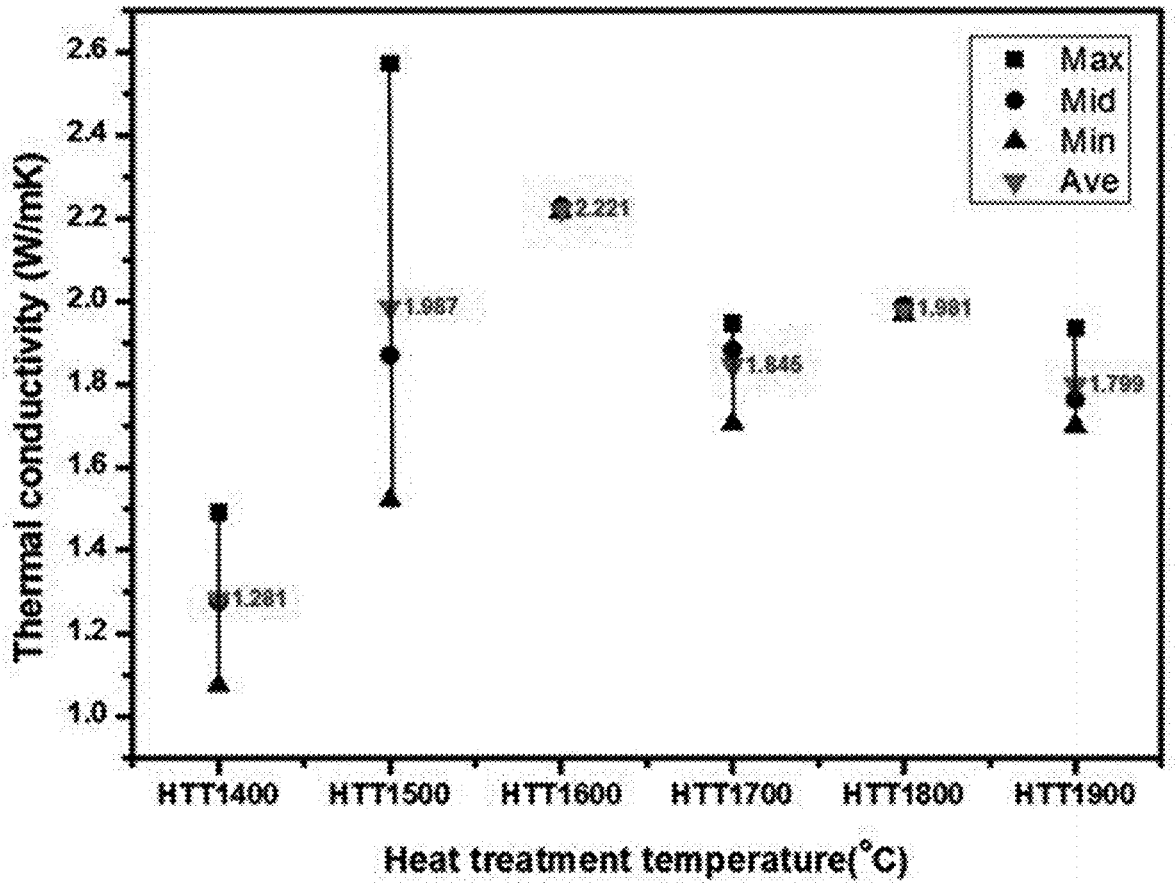
FIG. 8 shows thermal conductivity of the carbon heating element versus third carbonization heat treatment temperature.

FIG. 8 shows the thermal conductivity properties of the composition based on third carbonization heat treatment temperature. As shown in FIG. 8, the carbon heating element of embodiments shows thermal conductivity increases in line with an increase in the third carbonization heat treatment temperature, and then stabilizes or slightly decreases. The changes in the electrical and thermal properties of the carbon heating element versus third carbonization heat treatment temperature shown in FIG. 6 to FIG. 8 result from changes in the components and microstructure of the carbon heating element composition based on third carbonization heat treatment temperature.

Figure 9:
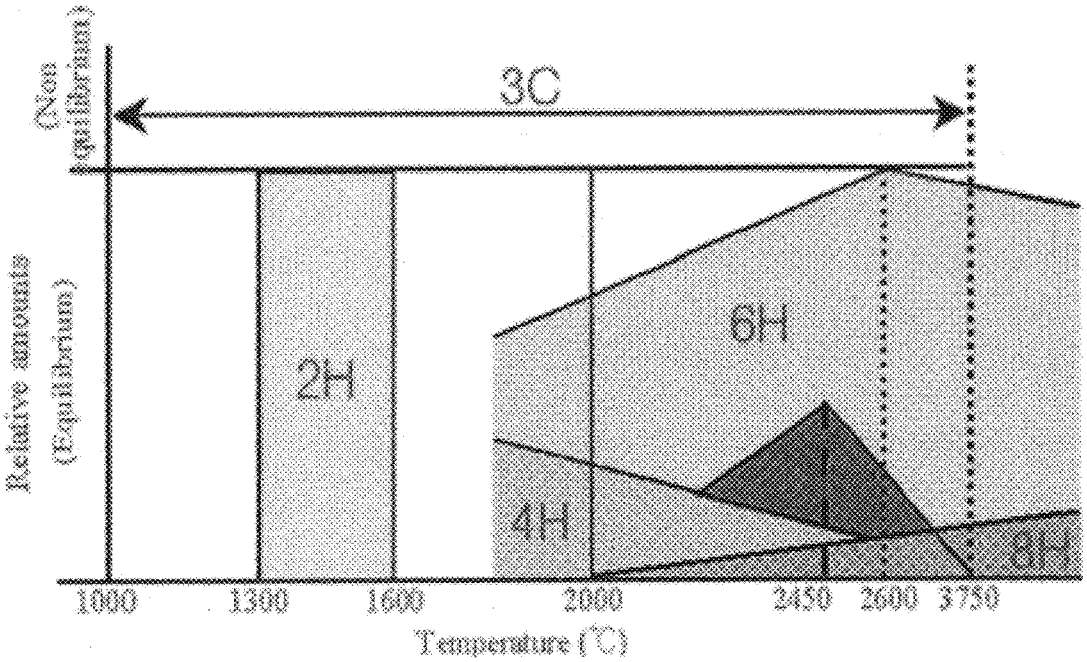
FIG. 9 shows temperature stable regions of main crystal polymorphs made of a SiC material.

SiC, which is one of inorganic components of the composition of the present disclosure, has crystal structures, such as, for example, cubic β-SiC, hexagonal, and 170 types of rhombohedral. The hexagonal and rhombohedral classes of SiC polytypes may be collectively known as α-SiC (refer to Ceramist, Volume 13, Issue 6, December 2010, pp. 64 to 74, which is incorporated by reference herein where appropriate for appropriate teachings of additional or alternative details, features, and/or technical background). As shown in the state diagram of FIG. 9, the SiC has different crystal structures over a temperature range of 1,000 to 2,700° C. or more.

Such SiC greatly differs from $SiO_2$ included in the composition of the embodiments in terms of melting point, thermal conductivity, and electrical properties, as shown in Table 1. First, with respect to melting point, $SiO_2$, which has a melting point of approximately 1,600° C., may not exist in a solid state at a temperature higher than this melting point.

Figure 10:
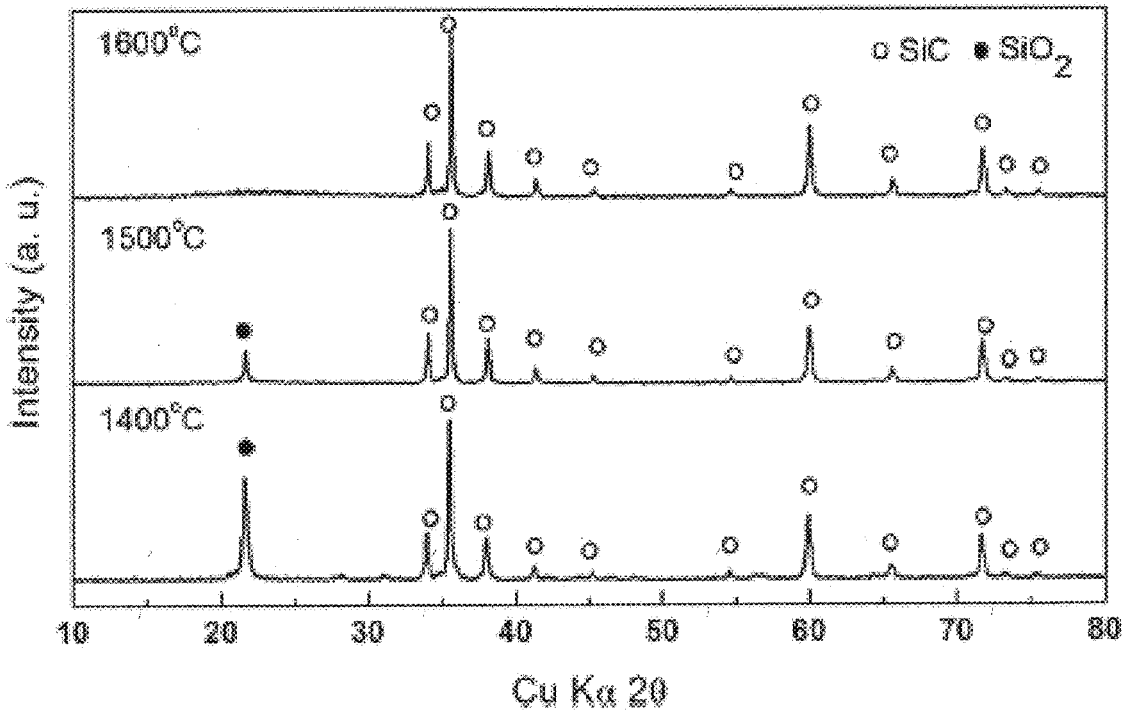
FIG. 10 shows XRD patterns of SiC and $SiO_2$ at different sintering temperatures.

FIG. 10 shows an XRD pattern published by other researchers (Ceramics International 38 (2012) pp. 5223-5229, which is incorporated by reference herein where appropriate for appropriate teachings of additional or alternative details, features, and/or technical background). FIG. 10 shows that the stability of SiC and $SiO_2$ varies according to temperature. For example, $SiO_2$ may no longer exist at a stable phase at 1,600° C. or more. The intensity ratio of the diffraction peak of $SiO_2$ to SiC at 1,500° C. is lower than the intensity ratio at 1,400° C., from which local decomposition of $SiO_2$ may already be in progress at 1,500° C.

The experiment results of FIG. 6 to FIG. 8 also correspond to the aforementioned experimental results. In FIG. 8, the thermal conductivity of the carbon heating element increases in line with an increase in the temperature, and then decreases or becomes constant. For example, the thermal conductivity increases continuously up to 1,600° C. This is due to a difference in thermal conductivity between SiC and $SiO_2$, as shown in Table 1 above.

$SiO_2$ having low thermal conductivity may become unstable as the third heat treatment temperature increases, and as a result, $SiO_2$ is coupled to carbon included in the composition to be phase transited to SiC having high thermal conductivity. As the ratio of SiC with high thermal conductivity increases, the macroscopic thermal conductivity of the carbon heating element may increase.

Even though the third heat treatment temperature may further increase, the phase transition has already been completed at 1,600° C. Thus, the thermal conductivity of the carbon heating element may remain almost unchanged or slightly decrease even when heated to a higher temperature.

The carbon heating element of embodiments is characterized by having a thermal conductivity of 1.6 W/m·K or more. When the thermal conductivity of the carbon heating element is lower than 1.6 W/m·K, heat may not be properly dissipated in the vicinity of the terminal when a voltage is applied to the carbon heating element. As a result, excessive thermal stresses or thermal impacts may be applied to the carbon heating element, and thus the carbon heating element having brittleness inherent in a ceramic material may be likely to be destroyed by the thermal stresses or thermal impacts applied thereto.

Figure 11:
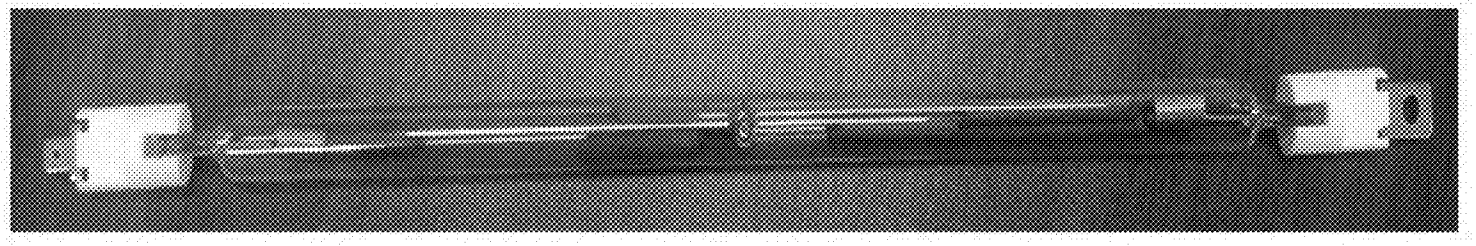
FIG. 11 is a photograph showing destruction of a carbon heating element having low thermal conductivity.

FIG. 11 is a photograph showing a carbon heating element assembly in which a carbon heating element is destroyed after excessive thermal stresses are applied to the carbon heating element. FIG. 6 and FIG. 7 respectively show the increasing electrical conductivity of the carbon heating element and the decreasing specific resistance thereof in line with an increase in the third carbonization heat treatment temperature. Changes in the electrical properties of the carbon heating element are also determined by the microstructure and components thereof.

As described above, $SiO_2$ may be locally melted and coupled to carbon included in the composition in line with an increase in the third carbonization heat treatment temperature to be phase transitioned to SiC. Therefore, the ratio of $SiO_2$ having high specific resistance decreases in the carbon heating element, while the ratio of SiC having low specific resistance increases in the carbon heating element.

As a result, the specific resistance of the carbon heating element decreases and the electrical conductivity increases in line with an increase in the third carbonization heat treatment temperature. However, even when the third carbonization heat treatment temperature is higher than 1,700° C., the electric conductivity constantly may increase and then may become saturated, unlike the thermal conductivity. This is due to a change in SiC constituting the carbon heating element.

Figure 12:
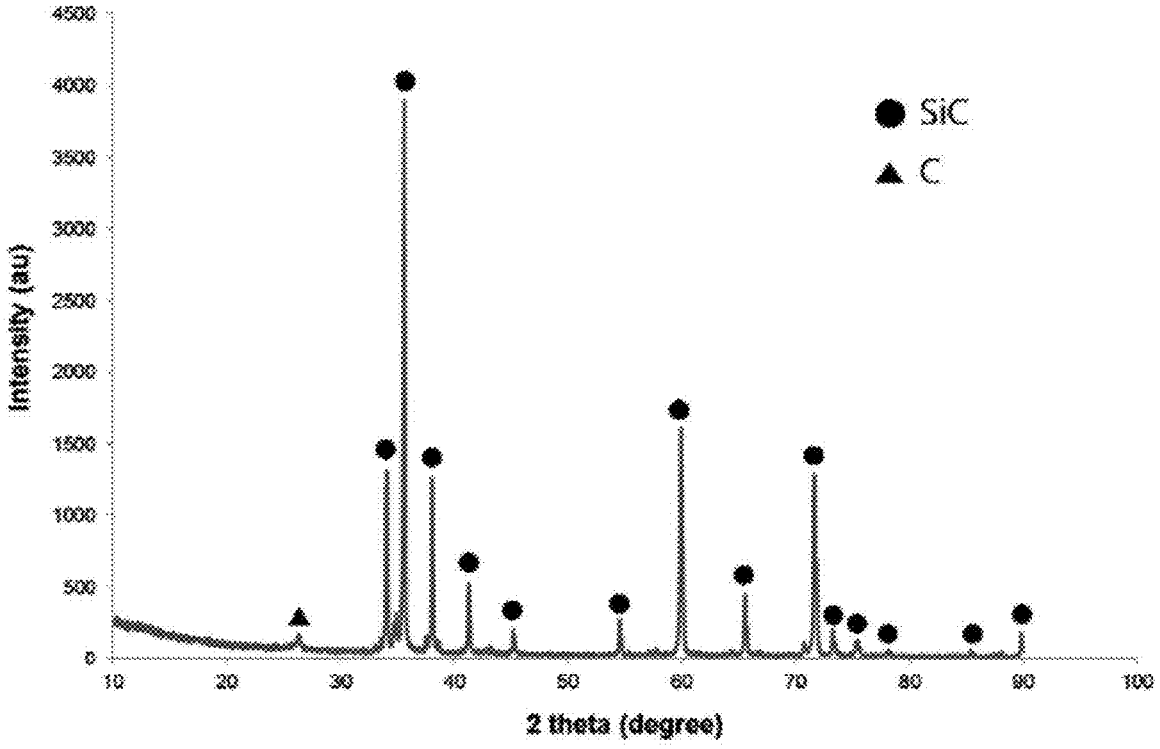
FIG. 12 shows an XRD pattern of the carbon heating element according to an embodiment, and FWHM measurement results according to third carbonization heat treatment temperature.

FIG. 12 shows an X-ray diffraction (XRD) pattern of a carbon heating element of embodiments, and a full width at half maximum (FWHM) of the XRD analysis result for measuring the degree of crystallization of SiC. In the embodiments, the XRD test was conducted using a D8 Advance model of Bruker. The XRD patterns were measured at a scan rate of 0.2 degree/sec under accelerating conditions of 60 kV and 80 mA by use of the Cu Kα wavelength. The XRD pattern was measured and analyzed using the software of Diffrac. Measurement Center/Diffrac. EVA.

As a result of the XRD test, the value of the FWHM decreased to 0.12 when the third carbonization heat treatment temperature increased to 1,800° C. or more. When the heat treatment temperature increases to 1,800° C. or more, the degree of crystallization of SiC generated by the third carbonization heat treatment as well as SiC existing in the initial composition of the carbon heating element increases. In other words, various defects may be reduced in SiC having a higher degree of crystallization, and as a result, the electrical conductivity may increase and the specific resistance decreases.

The carbon heating element of embodiments include both β-SiC and α-SiC, as shown from the XRD analysis results of FIG. 12. For example, α-SiC may be included in that it has relatively high thermal conductivity and a large band gap in comparison to β-SiC. Also, the carbon heating element of embodiments may have a FWHM value of 0.14 or more. When the FWHM value is less than 0.14, the degree of crystallization of SiC is excessively high, resulting in excessively high electrical conductivity and low specific resistance.

FIG. 13 shows SEM-EDS analysis results of the components before and after performing the third carbonization heat treatment on the composition having 56% of SiC, 18% of $SiO_2$, 23% of a binder resin, and 3% of a lubricant. An oxygen content of the heating element composition before performing the heat treatment thereon was measured to be about 17%, but the oxygen content of the composition after performing the heat treatment thereon was measured to be about 1%.

The oxygen that may exist in the carbon heating element of embodiments may be included in the composition with a starting material in the form of $SiO_2$, so that oxygen existing in the composition after performing the third carbonization heat treatment thereon will also exist as $SiO_2$.

But, as shown in FIG. 12, no peak for oxide was found in the XRD analysis results, unlike the EDS analysis results. Therefore, the oxygen of FIG. 13 is either partially decomposed $SiO_2$ or oxygen existing in a form other than $SiO_2$.

The oxygen content in the carbon heating element of embodiments may be 2% or less, even considering an error range of EDS. When the oxygen content exceeds 2%, the amount of remaining $SiO_2$ after performing the third carbonization heat treatment may be excessively large, which results in low thermal conductivity and excessively high specific resistance.

Figure 14:
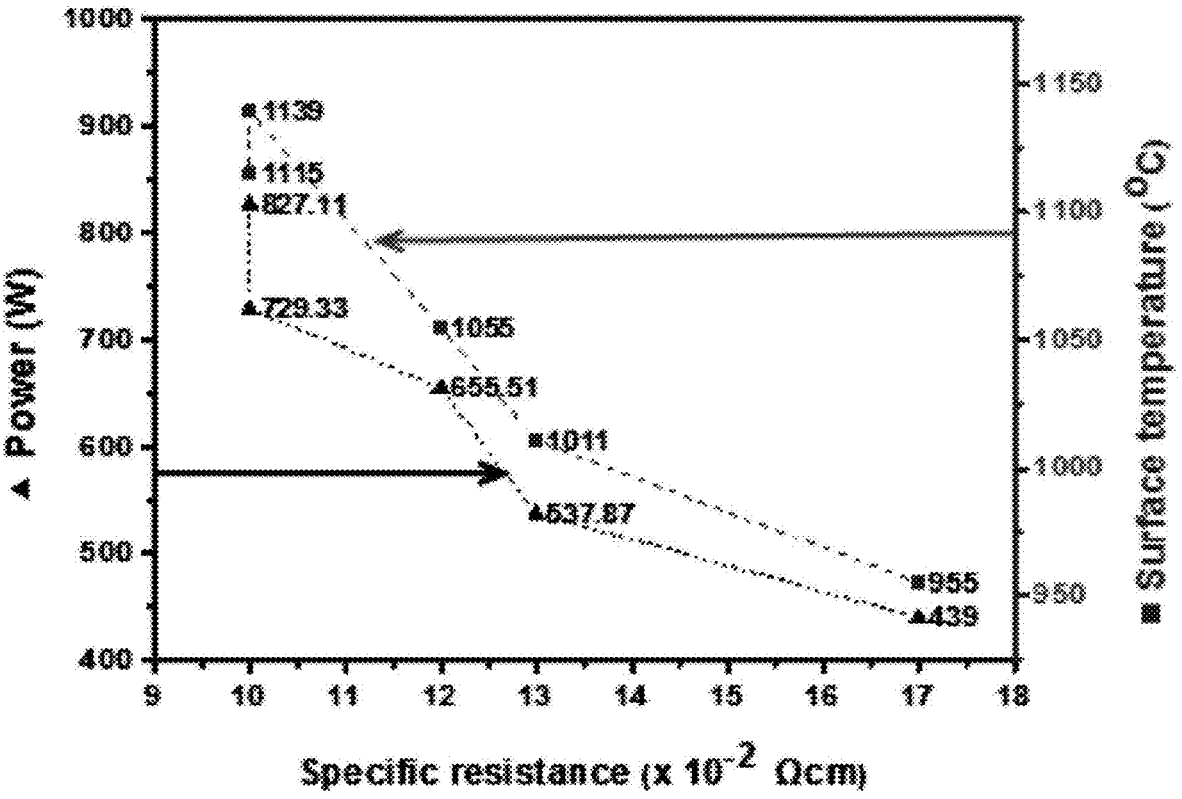
FIG. 14 shows power and surface temperature of a carbon heating element according to specific resistance.

FIG. 14 shows the surface temperature and output of a carbon heating element based on the specific resistance of the carbon heating element. The higher the specific resistance, the lower the power or energy consumed when heating the carbon heating element to a certain temperature. However, considering that the operating temperature at which the quartz tube may be used in the oven including the heater of embodiments may be 1,100° C., the carbon heating element of embodiments may have a specific resistance of $(11\sim16)*10^{-2}$ Ωcm.

When the specific resistance of the carbon heating element is less than $11*10^{-2}$ Ωcm, the power for obtaining the heating temperature of a desired carbon heating element may become too high, which may not be desirable in terms of energy efficiency. Conversely, when the specific resistance of the carbon heating element exceeds $16*10^{-2}$ Ωcm, the thermal conductivity may be lowered along with the specific resistance, so that the carbon heating element may be easily destroyed.

Figure 15:
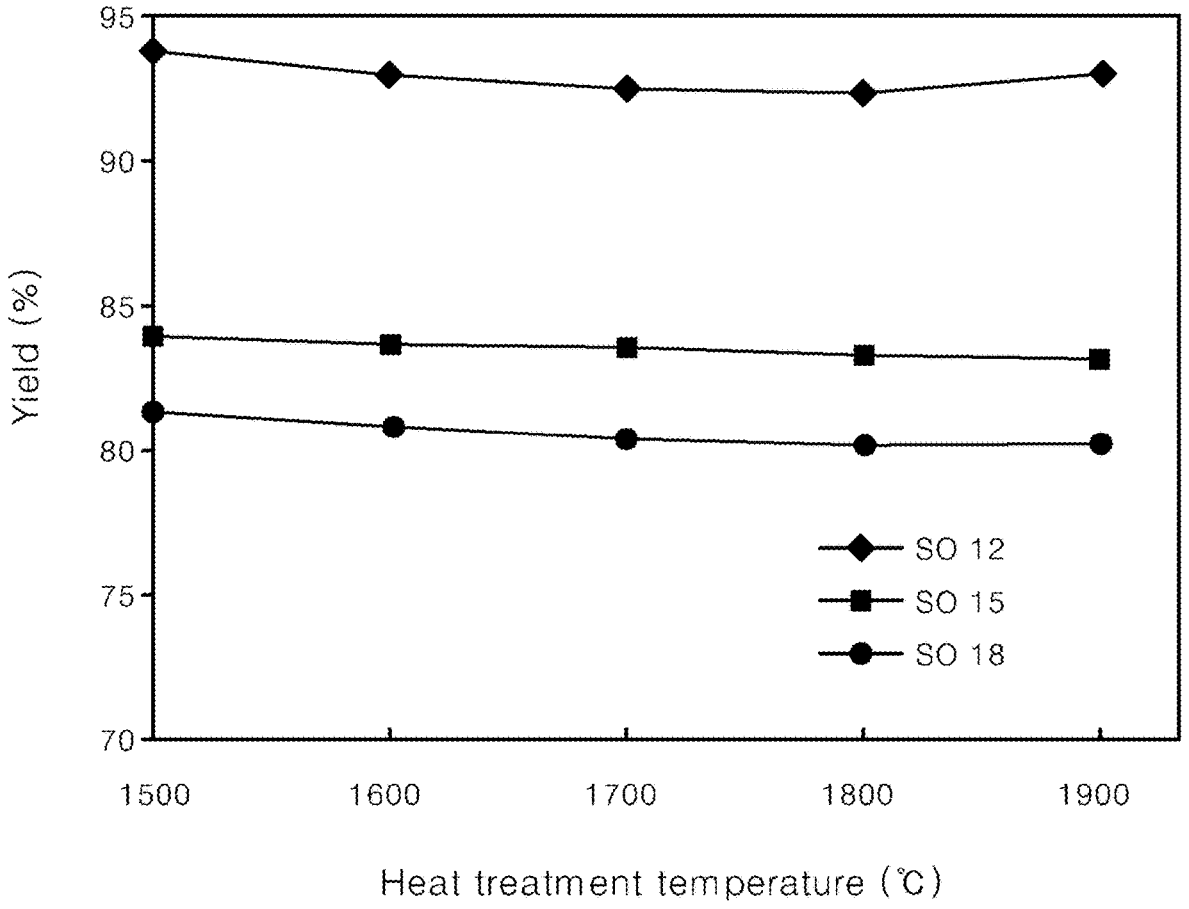
FIG. 15 shows yield measurement results according to temperature of a third carbonization heat treatment performed on carbon heating element compositions according to embodiments.

FIG. 15 shows yields obtained by performing a third carbonization heat treatment on compositions having 56 to 62% of SiC, 12 to 18% of $SiO_2$, 23% of the binder resin, and 3% of the lubricant. Yield is defined as a value obtained by dividing the weight of the carbon heating element, which is a final product, by the weight of the raw material before performing the third carbonization heat treatment, that is, the weight of the composition.

Referring to FIG. 15, even when the third carbonization heat treatment temperature increases, the yield of the composition of embodiments is not greatly changed. Rather, as the $SiO_2$ content increases, the yield tends to greatly decrease.

Such yield measurement results may correspond to the changes in the components and microstructure according to the third carbonization heat treatment of the carbon heating element, described above.

As the third carbonization heat treatment temperature increases to 1,500° C. or more, $SiO_2$ included in the carbon heating element composition of embodiments may be locally melted and coupled to carbon existing in the composition to be phase transitioned to SiC. This means that relatively heavier $SiO_2$ is phase-transited to lighter SiC. As a result, the weight of the carbonized heating element, which is a product, may be reduced and the yield may also be reduced. As the fraction of the phase transition increases, in other words, as the $SiO_2$ content in the carbon heating element composition increases, a reduction in weight resulting from the third carbonization heat treatment becomes larger, which may lead to a further reduction in yield.

Figure 16A:
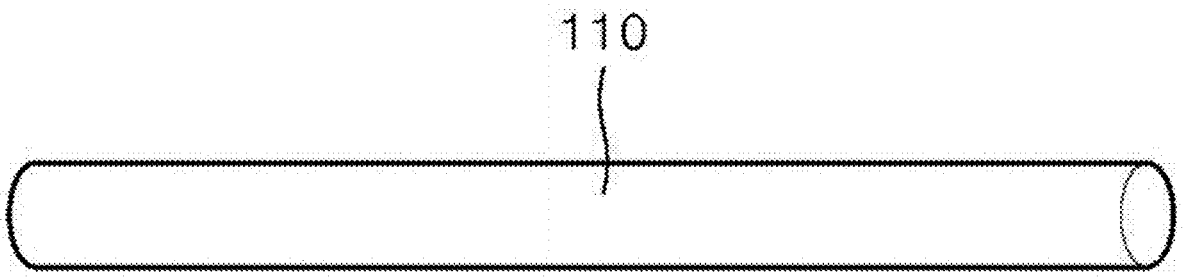
FIG. 16A to 16C shows shapes of solid carbon heating elements.
Figure 16B:
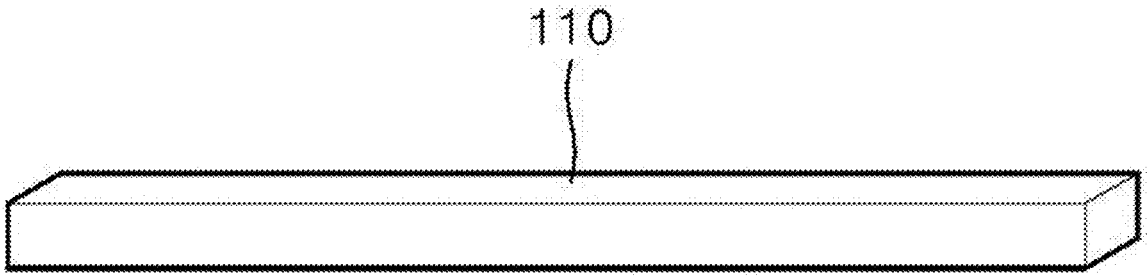
Figure 16C:
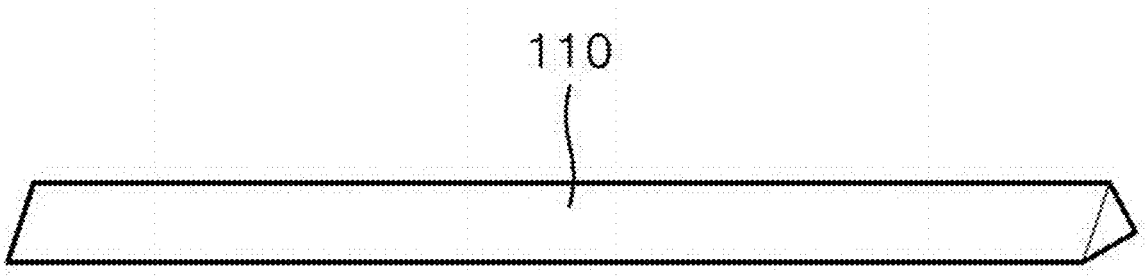

As shown in FIG. 16, a heating element 110 of the present disclosure may be provided in a solid bulk form having various shapes, such as, for example, a rod shape having a circular cross-section (FIG. 15A), a rod shape having a rectangular cross-section (FIG. 15B), and a rod shape having a triangular cross-section (FIG. 15C). However, the heating element according to embodiments may have a shape different from the aforementioned shapes.

Figure 17A:
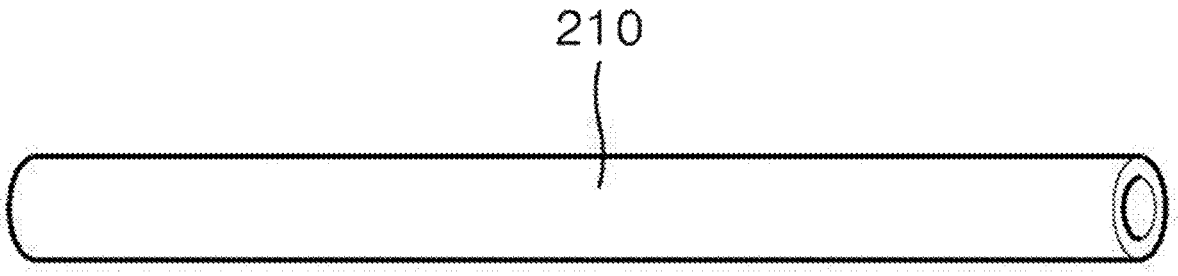
FIG. 17A and FIG. 17B are views of a carbon heating element formed in a tube shape having a central aperture according to an embodiment.
Figure 17B:
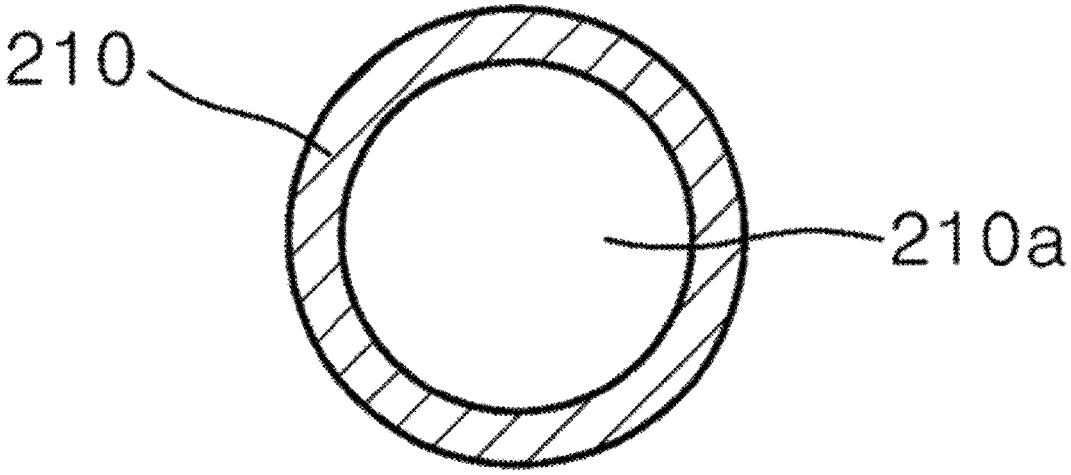

FIG. 17 shows one shape of a carbon heating element 210 included in the carbon heater according to another embodiment. The carbon heating element 210 shown in FIG. 17 may be formed in a tube shape having a central aperture or opening 210*a*. The size of the central aperture 210*a* or the ratio of the central aperture 210*a* to the entire cross-sectional area of the carbon heating element 210 may be changed in various ways, and is not limited to the illustrated shape.

Figure 18A:
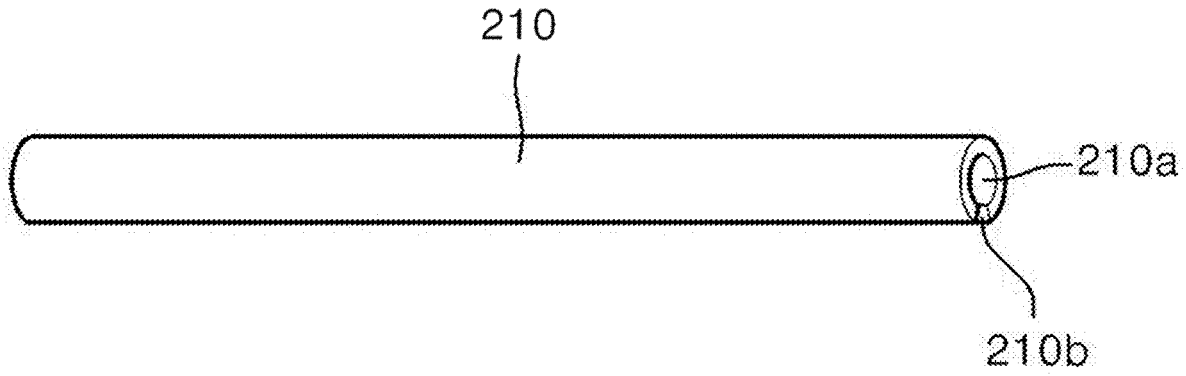
FIG. 18A and FIG. 18B are views of a carbon heating element having a shape in which a portion of a tube having a central aperture according to another embodiment is cut.
Figure 18B:
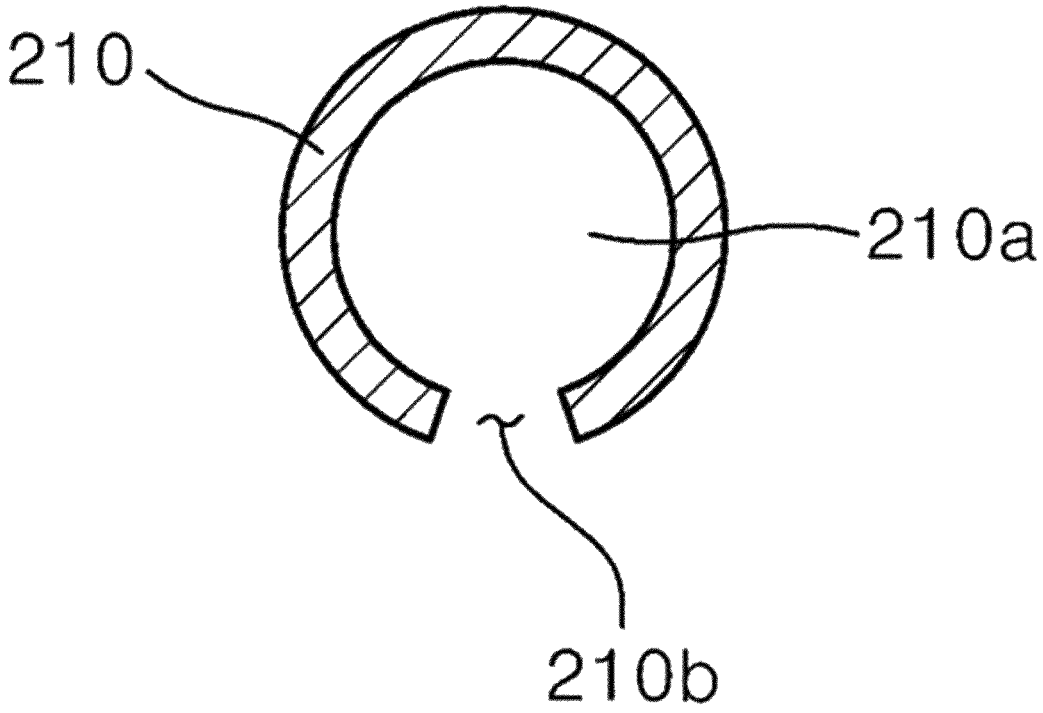

FIG. 18 shows another shape of the carbon heating element 210 included in the carbon heater according to another embodiment. The carbon heating element 210 shown in FIG. 18 may be formed in a tube shape having the central aperture 210*a*. Unlike the carbon heating element 210 shown in FIG. 17, the carbon heating element 210 of FIG. 18 may have a shape in which a portion of the tube may be cut such that a circular arc may be provided with a cut or opening 210*b*. The carbon heating elements 210 shown in FIG. 17 and FIG. 18 are different from each other in terms of whether or not there is the cut 210*b*, but are similar to each other in that both have the central aperture 210*a*.

Embodiments disclosed herein provide a carbon heater in which a dielectric breakdown, a spark, and plasma may not occur even under a high voltage. Embodiments disclosed herein further provide a heating element for a carbon heater which may not generate plasma even under a high voltage and encapsulation gas in the carbon heater.

According embodiments disclosed herein, a heating element capable of efficiently dissipating heat and preventing disconnection or destruction of the heating element to prolong a lifespan thereof without generating a spark and plasma under a high voltage may include carbon and silicon carbide (SiC), and the heating element may have a thermal conductivity of 1.6 W/m·K or more. The SiC may include β-SiC and α-SiC.

A degree of crystallization of SiC included in the heating element may have a full width at half maximum (FWHM) value of 0.14 or more as a result of analyzing an X-ray diffraction (XRD) pattern. The heating element may include silicon oxide ($SiO_2$).

A total amount of oxygen in the heating element may be less than 2 wt. % (hereinafter referred to as "%" or "wt. %"). The heating element may have a maximum surface temperature of 1,100° C. or less. The heating element may have a specific resistance of $(11\sim16)*10^{-2}$ Ωcm.

The heating element, which may have a relatively small surface area to achieve excellence in surface oxidation and surface erosion resistance at a high temperature, may be solid. The heating element may be hollow.

According to embodiments disclosed herein, a method for manufacturing a carbon heater, which may be capable of efficiently dissipating heat and preventing disconnection or destruction of the heating element to prolong a lifespan thereof without generating a spark and plasma under a high voltage, may include a process of mixing a heating element composition; a thermal extrusion process; a stabilization heat treatment process; and a carbonization heat treatment process.

The composition may include a base material determining the specific resistance of the heating element; a specific resistance controlling agent for controlling the specific resistance of the heating element; a lubricant; and a binder for mechanical coupling between inorganic powders. The base material may be SiC. The specific resistance controlling agent may be $SiO_2$. The lubricant may be graphite. The binder may be a novolac resin.

The extrusion process may be performed at a speed of about 60 rpm at 100 to 200° C. The stabilization heat treatment process may be performed at 270 to 320° C. for 10 minutes to 2 hours. The carbonization heat treatment process may include a first carbonization heat treatment process of out-gassing at 600 to 1,000° C. for 10 minutes to 2 hours.

The carbonization heat treatment process may include a second carbonization heat treatment process and/or a third carbonization heat treatment process. The second carbonization heat treatment process may be performed at 1,200 to 1,400° C. for 10 minutes to 4 hours. The third carbonization heat treatment process may be performed at 1,500 to 1,700° C. for 10 minutes to 4 hours.

Unlike a carbon heater using a conventional carbon fiber, the carbon heating element of embodiments may not generate a local voltage concentration between the filaments, which may be a disadvantage inherent in a fiber shape, thereby fundamentally preventing a dielectric breakdown or a spark from occurring. Further, unlike the carbon heater using the conventional carbon fiber, the carbon heating element of embodiments may fundamentally prevent plasma from occurring due to a local high voltage, and may improve a decline in the radiation efficiency because the shield member is not necessary.

The carbon heating element of embodiments may use binder made of the powders and resin as a starting material, and thereby it may be possible to easily manufacture a carbon heater having a desired shape for an oven having various sizes and shapes. Also, the carbon heating element of embodiments may control the specific resistance and power of the carbon heater by changing components and composition ranges of the composition, and thereby may improve the degree of freedom of the electrical design of the carbon heater.

In addition, the carbon heating element of embodiments may have excellent thermal conductivity, so that heat may be efficiently dissipated in vicinity of a terminal portion to which external power is supplied. As a result, it may be possible to prevent a breakage or disconnection of the heating element in the vicinity of the terminal portion of the carbon heater, thereby improving a service life.

The carbon heating element of embodiments may have a relatively small surface area ratio in comparison to the conventional carbon fiber, thereby achieving excellence in resistance to surface oxidation or surface erosion which may occur frequently at a high temperature. Such property of the composition may make it possible to omit a post treatment process, such as, for example, a surface coating necessary for the conventional carbon fiber, thereby improving lead time and productivity.

In order to clearly describe embodiments, description irrelevant to the embodiments has been omitted. Same or like reference numerals designate same or like elements throughout the specification. Further, some exemplary embodiments will be described in detail with reference to the illustrative drawings. Regarding the reference numerals assigned to the elements in the drawings, it should be noted that the same elements will be designated by the same reference numerals, wherever possible, even though they are shown in different drawings. Furthermore, in the description of the embodiments, the detailed description of well-known related configurations or functions will be omitted when it is deemed that such description will cause ambiguous interpretation.

Also, in the description of the elements, terms such as first, second, A, B, (a), (b) or the like may be used herein when describing elements of the present invention. Each of these terms is not used to define an essence, order or sequence of a corresponding element but used merely to distinguish the corresponding element from other element(s). It should be noted that if it is described in the specification that one element is "connected," "coupled" or "joined" to another element, the former may be directly "connected," "coupled," and "joined" to the latter or "connected", "coupled", and "joined" to the latter via another element.

In addition, in the implementation of embodiments, the features embodiments may be described as being performed by separate elements for convenience of illustration. However, these features may be implemented by a single device or module or one feature may be implemented by several devices or modules.

Embodiments are described with reference to illustrative drawings, but are not limited by the embodiments described herein and accompanying drawings. It should be apparent to those skilled in the art that various changes which are not exemplified herein but are still within the spirit and scope may be made. Further, it should be apparent that, although an effect from a configuration is not clearly described in the exemplary embodiments, any effect, which can be predicted from the corresponding configuration, is also to be acknowledged.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A heating element for a carbon heater, the heating element substantially consisting of:

carbon (C);

silicon carbide (SiC); and oxygen(O), wherein a total amount of oxygen in the heating element is 2 wt. % or less, wherein the heating element has a thermal conductivity of 1.6 W/m·K or more and a specific resistance of the heating element is (11~16) $*10^{-2}$ Ωcm.

2. The heating element according to claim 1, wherein the SiC includes β-SiC and α-SiC.

3. The heating element according to claim 1, wherein a degree of crystallization of the SiC in the heating element has a full width at half maximum (FWHM) value of 0.14 as a result of analyzing an X-ray diffraction.

4. The heating element according to claim 1, wherein the heating element includes silicon oxide ($SiO_2$).

5. The heating element according to claim 1, wherein the heating element is solid.

6. The heating element according to claim 1, wherein the heating element is hollow.

* * * * *